US010948272B1

(12) United States Patent
Drobockyi et al.

(10) Patent No.: US 10,948,272 B1
(45) Date of Patent: Mar. 16, 2021

(54) FIREARM CASING WITH SHROUD

(71) Applicants: Volodymyr Drobockyi, Hebron, CT (US); Anthony Viggiano, Groton, CT (US)

(72) Inventors: Volodymyr Drobockyi, Hebron, CT (US); Anthony Viggiano, Groton, CT (US)

(73) Assignee: SHELL SHOCK TECNOLOGIES LLC, Westport, CT (US)

( * ) Notice: Subject to any disclaimer, the term of this patent is extended or adjusted under 35 U.S.C. 154(b) by 0 days.

(21) Appl. No.: 15/853,824

(22) Filed: Dec. 24, 2017

Related U.S. Application Data

(63) Continuation-in-part of application No. 15/221,530, filed on Jul. 27, 2016, now Pat. No. 10,260,847.

(60) Provisional application No. 62/439,027, filed on Dec. 24, 2016.

(51) Int. Cl.
*F42B 5/285* (2006.01)
*F42B 5/02* (2006.01)
*F42C 19/08* (2006.01)

(52) U.S. Cl.
CPC ..... *F42B 5/285* (2013.01); *F42B 5/02* (2013.01); *F42C 19/083* (2013.01); *F42C 19/0807* (2013.01)

(58) Field of Classification Search
CPC ..... F42B 5/02; F42B 5/26; F42B 5/28; F42B 5/285; F42B 5/30; F42B 5/307; F42B 5/313; F42B 33/04; F42B 33/001; F42C 19/083; F42C 19/08; F42C 19/0807
USPC ..... 102/464, 465, 466, 469, 470
See application file for complete search history.

(56) References Cited

U.S. PATENT DOCUMENTS

| | | | | |
|---|---|---|---|---|
| 3,099,958 | A * | 8/1963 | Daubenspeck | F42B 7/06 102/449 |
| 3,745,924 | A * | 7/1973 | Scanlon | F42B 5/307 102/467 |
| 3,842,739 | A * | 10/1974 | Scanlon | F42B 5/073 102/467 |
| 3,977,326 | A * | 8/1976 | Anderson | F42B 5/307 102/467 |
| 3,990,366 | A * | 11/1976 | Scanlon | F42B 5/26 102/467 |
| 5,151,555 | A * | 9/1992 | Vatsvog | F42B 5/307 86/10 |
| 9,939,236 | B2 * | 4/2018 | Drobockyi | F42B 5/285 |
| 10,260,847 | B2 * | 4/2019 | Viggiano | F42B 5/285 |
| 10,697,743 | B2 * | 6/2020 | Viggiano | F42C 19/0807 |
| 2018/0292186 | A1 * | 10/2018 | Padgett | F42C 19/083 |
| 2019/0242679 | A1 * | 8/2019 | Viggiano | F42B 5/285 |

FOREIGN PATENT DOCUMENTS

WO WO-2008091245 A2 * 7/2008 ..... F42B 5/29

* cited by examiner

*Primary Examiner* — James S Bergin
(74) *Attorney, Agent, or Firm* — C. Nessler

(57) ABSTRACT

A cartridge for a firearm comprises a casing which comprises a sleeve that is mated with a base. Propellant and a bullet are contained within concavity of the sleeve. The sleeve comprises a nipple extending from a bulkhead. The nipple is flared within a passageway of the base, to hold the base and sleeve together. The base comprises a base substrate and shroud. The shroud is a ring like element around the end of the base which abuts the bulkhead of the sleeve. The shroud may provide structural strength and may be colored, textured or marked; or may hold a RFID tag.

14 Claims, 5 Drawing Sheets

FIREARM CASING WITH SHROUD

This application is a continuation in part of patent application Ser. No. 15/221,530 filed Jul. 27, 2016 and claims benefit of provisional patent application Ser. No. 62/439,027, filed Dec. 24, 2016. The disclosure of each application is hereby incorporated by reference in its entirety.

TECHNICAL FIELD

The present invention relates to cartridges and casings used as ammunition for firearms.

BACKGROUND

A cartridge construction in which a sleeve having a nipple is mated with a base to form a two-piece casing which is then suitable for receiving propellant, a bullet, and a primer, to form a cartridge for a firearm is described in U.S. patent application Ser. No. 15/221,530, entitled "Fire Arm Casing and Cartridge," filed Jul. 27, 2016, ("the '530 application" or "the parent application" below).

This present invention represents further improvements and novel modifications of the prior invention, useful for identifying classes of cartridges or improving the performance of casings when cartridges present special needs, such as those used in high powered rifles.

Suppliers of ammunition understandably may wish to differentiate their cartridge products from those of other manufacturers. In the same vein, a manufacturer may desire to differentiate one kind of ammunition product from another, even though the external configuration (i.e., the shape) of the cartridge is unchanged or where differences with others are hard quickly to discern. For example, the propellant powder loading may differ amongst same-looking cartridges. One way of differentiation would be to color part or all of the cartridge. However, the coloring means has to be economical, adapted to high speed manufacturing, and durable during expected handling of cartridges and possible re-use of casings. Furthermore, any surface coloring means ought not to leave residue in the breech of the firearm.

Some people seek to have ammunition marked with a serial number or other identification, so the ammunition can be traced as to source and purchaser. Krystyniak U.S. Pat. No. 4,222,330 describes incorporating ferrites having different Curie temperatures in the propellant or bullet. An identifying system has to be compatible with such. A known way of identifying metal products is through laser marking or stamping, for instance by applying a serial number. Because of the small sizes of many cartridges, such numbers may be hard to read. Thus there is a continuing desire for improvements in ways of identifying cartridges as subsets of a large group or as individual units.

In casing embodiments of the '530 application, the base of a casing (also called the head by some patentees) might be made of a metal or non-metal material which provides less than the desired strength, but which is chosen for another reason such as corrosion resistance, fabricability, light weight, lower cost, etc. It would be useful to improve the strength of the base when made from such materials. And may be useful to make the bases magnetically attractive also without sacrificing all of the low weight advantage of preferred light metal alloys, such as aluminum alloys.

SUMMARY

An object of the invention is to provide an improved cartridge comprising a casing, for use in a firearm; more particularly, to provide improvements to the base of a two-piece casing comprising a base and a sleeve attached by means of a nipple. Another object is to provide a base that provides such casing with a structural or non-structural feature that improves the casing performance or imparts characteristics that are advantageous, compared to a subject two-piece casing which has a one piece/monolithic base. A still further object is to provide a two-piece casing with a visual or electronic identifying means.

In accord with the present invention, a cartridge for a firearm has a casing which is comprised of a base assembly and a sleeve. The sleeve has a radially-running bulkhead from which runs a nipple that is captured with the passageway of the base assembly. The base is comprised of base substrate and a circumscribing shroud at the proximal end of the base substrate, which end is adjacent the bulkhead. A base substrate has a generally cylindrical exterior surface and a central through-passageway. At the distal end of the base (that end which is farthest from the open mouth bullet receiving end of the casing) a primer may be positioned in a recess that is part of the passageway. The distal end of the base/casing also has a flange or a cannelure for engagement of the base/casing by the grippers of a breech block.

In embodiments of the invention, a casing has a first type of shroud which is ring-like or collar like and runs circumferentially on the cylindrical exterior surface. At the proximal end, the shroud is adjacent the outer edge of the bulkhead. Another casing has a second type of shroud which has a portion like the first type; and in addition, a second portion which is a flange, that runs radially inward in the direction of the passageway in the base substrate, where is located the nipple of the sleeve. Optionally, a washer is interposed between the bulkhead and the base, to carry load that the shroud is not intended for, and to support the outer edge of the bulkhead, to hinder failure there during firing of a cartridge . . . .

A shroud may be made of one of several materials, including metal, ceramic, or plastic. In certain embodiments the shroud has a property set (yield strength, hardness and elastic modulus) which has greater values than the property set of the base substrate. Such as shroud thus hoop-strengthens the base, making the base as strong a same-size monolithic base made of the same material as the base substrate. For example, a steel shroud provides strength to an aluminum alloy base substrate. In other embodiments, the shroud is made of a material which has a property set which has lesser values than the property set of the base substrate. For example, a plastic or aluminum alloy shroud is used with a high strength aluminum alloy base substrate. Such a shroud may be textured or colored or otherwise treated to distinguish one class of cartridge from another. Such a shroud may incorporate or hold a RFID tag.

The invention casings are improved with respect to being light in weight and higher in performance than and economic to manufacture, corrosion resistant, resistant to damage in handling and use, accommodative of primers currently in use, and suited for re-loading after use. The invention enables identifying and distinguishing amongst cartridges and casings of small caliber and large caliber ammunition. The foregoing and other objects, features and advantages of the present invention will become more apparent from the following description of preferred embodiments and accompanying drawings.

DESCRIPTION OF EMBODIMENTS OF THE INVENTION

Figure 1:
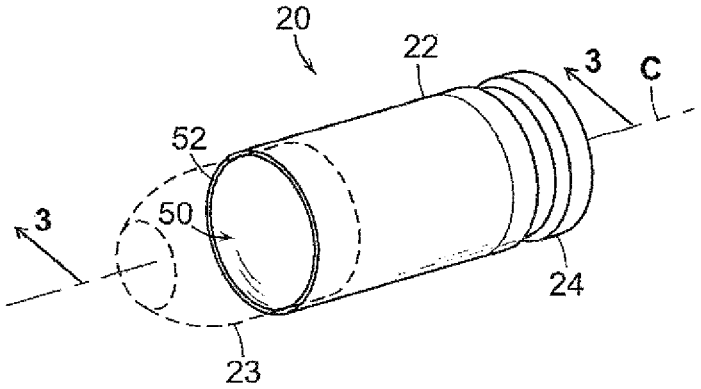
FIG. 1 is a perspective view of a casing that is comprised of two mated elements, a sleeve made of steel alloy and a base made of aluminum alloy, with a bullet in the mouth of the casing, shown in phantom.
Figure 2:
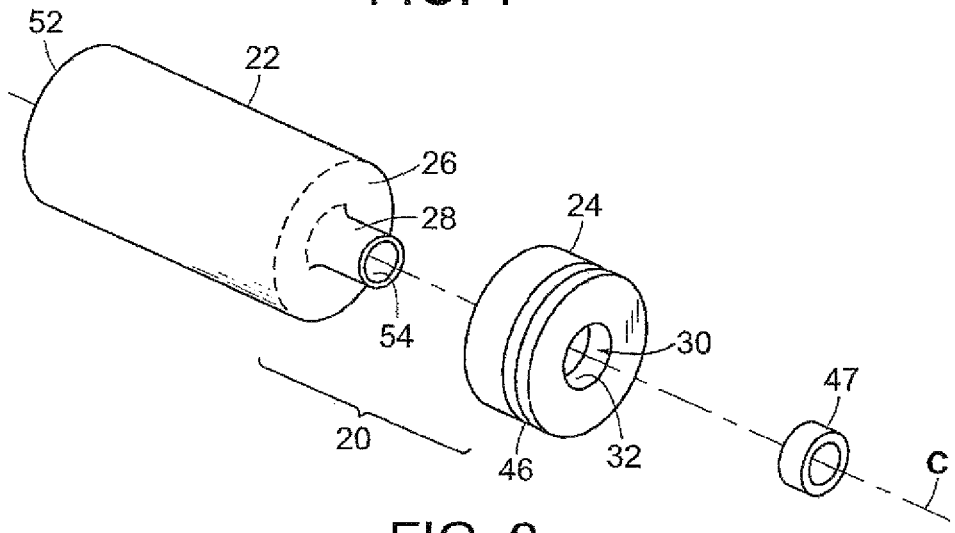
FIG. 2 is an exploded view of the casing of FIG. 1, along with a primer.
Figure 3:
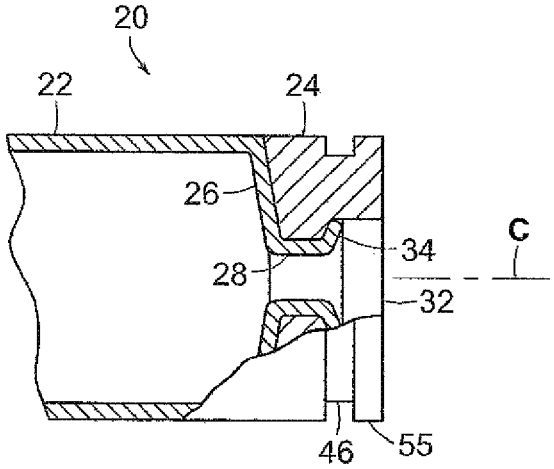
FIG. 3 is a partial cross section of the casing of FIG. 1.

FIGS. 1, 2 and 3 show a cartridge comprised of two piece casing as described in patent application Ser. No. 15/221,530, filed Jul. 27, 2016, entitled "Firearm casing and cartridge," the disclosure of which is hereby incorporated by reference. FIG. 1 is a perspective view of a casing 20 of the present invention. FIG. 2 is an exploded view and shows in addition a primer 47. FIG. 3 is a partial cross section of the assembly of FIG. 1. The casing is an assembly and the components have corresponding lengths, length axes, proximal ends, and distal ends. Casing 20 has a central length axis C, a distal end where is the recess for a primer, and a proximal end where the bullet is received in the mouth of the casing. A proximal end also may be referred to herein as a first end and a distal end as a second end.

Sleeve 22 has a major portion which is nominally cylindrical. The proximal end of the sleeve comprises mouth 50, which has an edge 52. The mouth is shaped to receive a projectile (bullet) 23. (The sleeve is sometimes colloquially referred to as the "cylinder" of the casing. Within the scope of "nominally cylindrical" will be a sleeve which has a necked down (reduced diameter) portion near the proximal end, to fit a smaller diameter projectile; that is a configuration of casing which is familiar in many commercial rifle cartridges.)

To form a cartridge from a casing A bullet 23, shown in phantom, is inserted into and frictionally engaged with the mouth end of the sleeve, after propellant is put within the interior cavity of the sleeve. In a conventional 9 mm cartridge the bullet will set about 0.19 inches (4.8 mm) deep within the cylindrical open end of the sleeve. Other closures may be used for closing the mouth opening and for containing gunpowder in casings of the present invention. For instance, wadding may be used in a so-called blank round. Any closure in the mouth of the casing shall be equivalent to a bullet. The term "projectile" is interchangeable here with "bullet."

With reference to FIG. 2 and FIG. 3, sleeve 22 has a nipple 28 which is received in the bore of passageway 30 which runs through the base 24. Base 24 is nominally disk-like in shape and has a cannelure 46, also called an extraction groove, on the exterior. Recess 32 in the passageway 30, at the proximal end of the base, is shaped to receive a nominally cylindrical primer 47 with a press-fit. The recess defines a shoulder for receiving a lip of a sleeve nipple. As can be seen in FIG. 3, in the assembly which comprises casing 20, sleeve 22 has a radially inward-running bulkhead 26 that abuts the proximal end surface of the base. The sleeve is secured to the base by means which comprises lip 34 of nipple 28 of the sleeve. The lip may be formed by in-place by cold deformation (flaring) of the terminal end of the nipple. When a primer is pressed into the recess the feet of the anvil of the primer will be close to or in contact with the surface of the lip which faces distally. In articles shown in the remaining Figures here, elements which correspond with elements in the foregoing Figures mostly share the same last two digits.

Preferably, the sleeve is made of magnetic austenitic stainless steel and the base is made of another metal, such as machined strong aluminum alloy. Preferred material choices are detailed near the end of this description.

Figure 4:
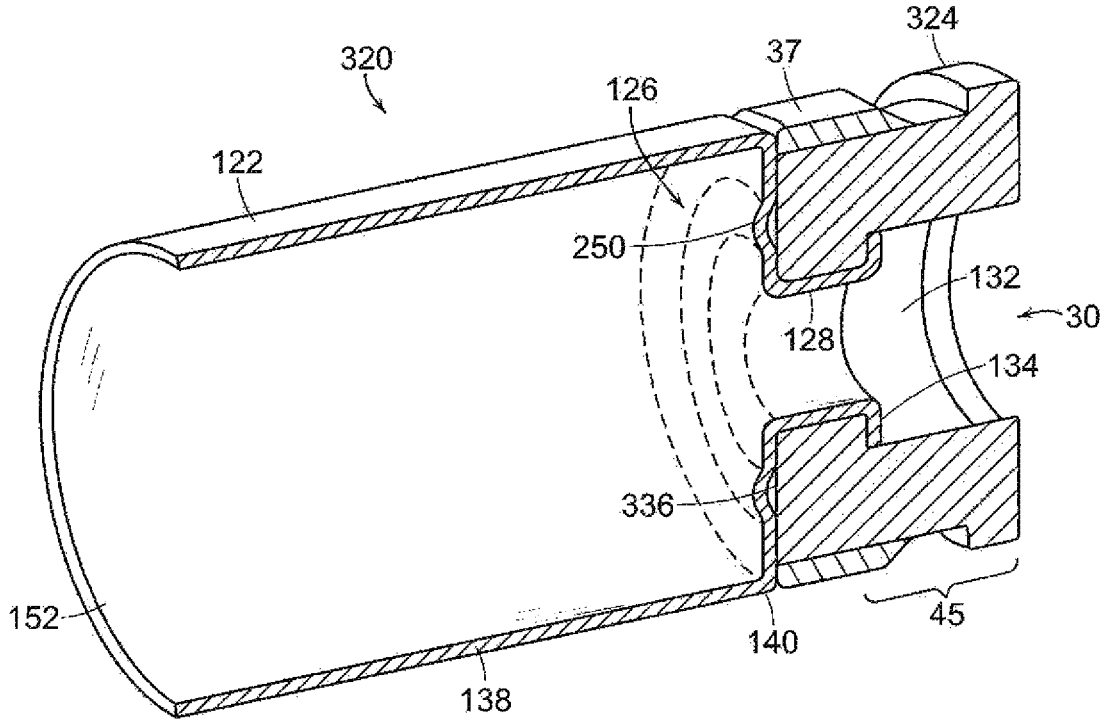
FIG. 4 is a lengthwise cross section through a casing showing how the nipple of a sleeve is secured to a base assembly which comprises a base with a shroud having a ring shape.

FIG. 4 is a cross section along the lengthwise axis of a casing which comprises a shroud at the base. Generally, in improved casings described herein, the casing of a firearm cartridge has a base which is an assembly comprised of two parts: the base substrate and a shroud. The term "base substrate" refers to the portion of the base upon which the shroud is mounted. Generally, in embodiments of the present invention a shroud is mounted on the exterior surface of a portion of the base substrate, and at least circumscribes a portion of the proximal end of the base substrate. And, the surface of the base at the proximal end is formed by the combination of portions of the proximal end of the base substrate and of the proximal end of the shroud. Typically, the exterior surface of the proximal end of the shroud will have the same diameter as the exterior surface of the cylindrical portion of sleeve which is proximate the bulkhead.

FIG. 4 shows casing 320, an embodiment of the invention, comprised of sleeve 122 and base 45, both centered on lengthwise axis C. Sleeve 122 has a proximal end 152 which defines the mouth of the casing that is shaped for receiving a bullet, a cylindrical wall portion 138, and a bulkhead 126 which largely closes off the end of the sleeve which is in contact with the surface 336 of the proximal end of the base 45.

To manufacture casing 320, sleeve nipple 128 is placed into passageway 30 which runs axially through the base, and the terminal end of the nipple is then flared radially outwardly to form lip 134. Further in the manufacturing process, a primer (not shown), typically having a brass housing, is press fitted into chamfered opening of recess 132 at the distal end of base 324; and, after propellant is deposited into the concavity of the sleeve, a bullet is press fitted into the mouth of the sleeve to form a cartridge ready for use.

Figure 5:
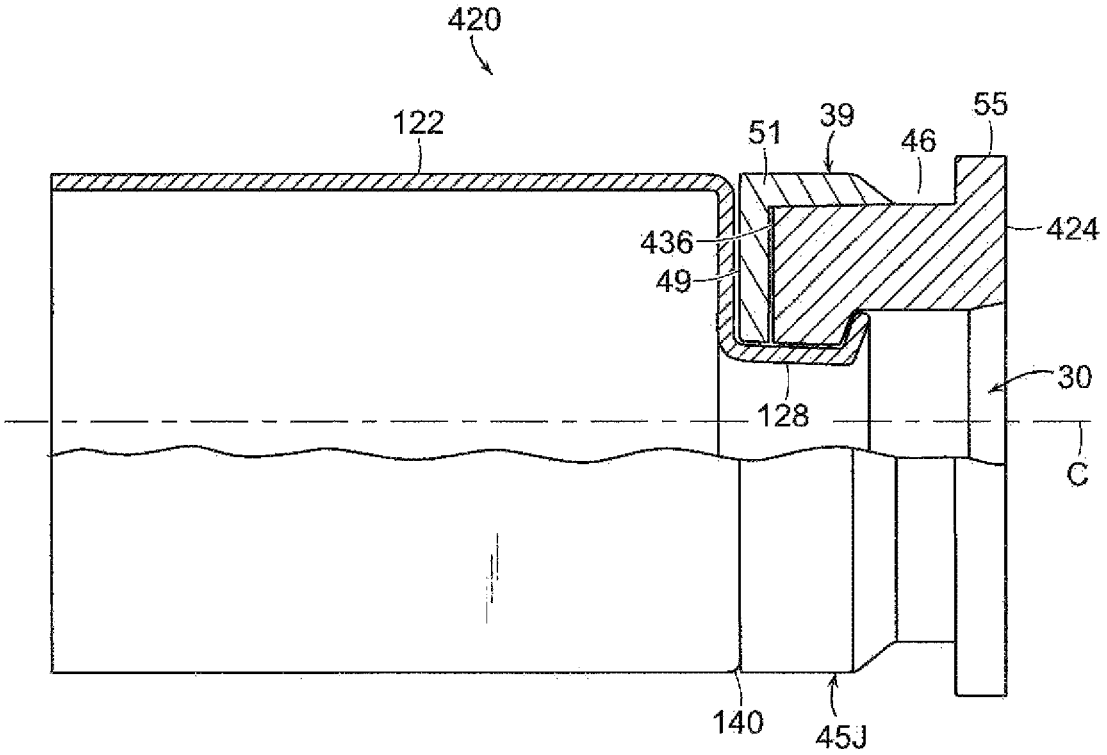
FIG. 5 is a partial lengthwise cross section through a casing showing how the nipple of a sleeve is secured to the base assembly, where the base assembly comprises a shroud having flange portion.
Figure 10:
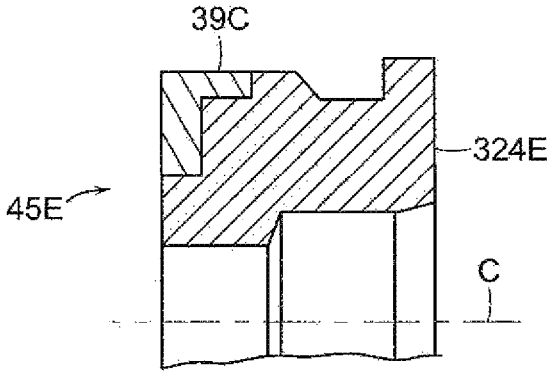

With reference to related FIG. 5, the distal end of base 424 comprises a flange 55 and that cooperates with the distal end of the shroud to provide cannelure 46, that is, a circumscribing groove which enables grasping of the casing by the grips of a breech block of a firearm when a cartridge/casing is being put into and removed from the breech/chamber of a firearm. In alternate embodiments the distal end of the base substrate is machined to form the cannelure, as shown in FIG. 3 and FIG. 10.

As detailed in the '530 application, in embodiments of the invention a casing of the present invention preferably has one or more of several features which facilitate having a thin wall sleeve with good resistance to failure under the high pressures associated with firing a bullet. Those include:

(a) The intersection of the bulkhead with the sleeve cylindrical wall is preferably formed to a very tight mean radius, at least 0.05 inches or less, preferably about 0.024 inches.

(b) The bulkhead preferably has at least one wave (ridge) that runs circumferentially at diameters intermediate the diameter of the nipple and the diameter of the outer edge of the bulkhead. Each wave creates a hollow where the bulkhead faces the adjacent surface of the base. (Waves are omitted for simplicity of drawing in many of the Figures herein.)

(c) The bulkhead preferably runs at a nominal 90 degree angle to the length of the nipple, and the bulkhead and the surface of the base that abuts the bulkhead are shaped so that there is a void space around the nipple, near the passageway.

(d) The nipple has a flared proximal end to hold it to the base and form a first seal at the location of the passageway recess at the distal end of the base where the primer is received; and preferably there is a second seal between the outer surface of the nipple and the bore of the passageway, nearer to the bulkhead.

(e) The sleeve is made of an austenitic stainless steel, preferably AISI 304 stainless steel, and the steel is in a worked-condition, whereby it is readily attracted to a magnet. The material at the sleeve cylindrical wall has an ultimate tensile strength greater than 75,000 to 125,000 psi and a Rockwell C hardness greater than 31.

Referring again to FIG. 4, casing 320 comprises a base 45 which is an assembly of base substrate 324 and shroud 37. Shroud 37 has a collar-like or ring-like shape; and the exterior surface is treated here as being nominally cylindrical—that comprehends that there may be a taper or cannelure-defining portion at the distal end of the shroud.

The outside surface of the shroud has the same diameter as the outer edge 140 of the circular bulkhead and thus the same diameter as the cylindrical wall of the casing adjacent the outer edge 140.

FIG. 5 shows casing 420 which is much like casing 320. Casing 420 comprises base 45J which is an assembly of base substrate 424 and shroud 39. Shroud 39 comprises a first portion, namely ring 51 that is collar-like, and a second portion, namely flange 49, that runs inwardly toward center axis C (which is also toward the location of the nipple 128 and passageway 30). Flange 49 covers the surface 436 of the base 45J.

Shroud 37 is called here a Type I shroud: the shroud only circumscribes the axial exterior of the base substrate. Shroud 39 is called a Type II shroud: the shroud has in addition a portion that extends radially inward. See further discussion below.

In embodiments of the invention discussed below shrouds have one or more of the following features: (a) a shroud is made of a material that is dissimilar in properties or appearance from those of the base substrate and sleeve; (b) a shroud has relatively little load bearing capacity, such as a common thermoplastic with filler including filaments, compared to a common structural metal; (c) a shroud has load bearing capacity and transfers load to the structure of the base or receives and shares load with the base; (d) a shroud carries or protects a RFID tag; and, (e) the shroud provides part or all of a cannelure.

Because the nipple is flared within the base during fabrication of a casing, and because there are high gas pressures associated with deflagration when a bullet is fired, the base substrate is most preferably made of a strong metal, as described below and in the '530 application. Nonetheless, sufficiently strong special ceramics and engineered plastics may be contemplated for a base.

Some base embodiments will comprise a shroud (a) that is made of the same material as the material of the base substrate; or (b) that is made of a different material having structural-mechanical properties (e.g., yield strength, hardness, and modulus of elasticity, called hereafter "property set") which are nominally equal to or greater than those of the base substrate, i.e., that material of which the base would be entirely made, but for the shroud. Such shrouds can provide the bulkhead with at least the same structural support as does a base of the same shape that had no shroud.

In one example the base substrate is made of a ferrous, copper, aluminum, or zinc base metal alloy and the shroud is made of one of the same materials (with the shroud optionally being the same material as the base substrate or a different material). In another example, the base is made of a material as just said and the shroud is made of a non-metal (e.g., a plastic or ceramic).

A same-material shroud on a base substrate, compared to having one integral piece, may enable something (such as a RFID chip) to be embedded within or underneath the shroud, or may enable the shroud to be treated or finished in a way which is either infeasible or undesirable to apply to a one piece base.

For conceptual purposes, shrouds may be characterized according to type, as follows:

A Type I shroud is ring-like (sleeve-like) in configuration; it circumscribes the generally cylindrical exterior surface of the base substrate. The shroud does not comprise a portion, namely a flange, that that extends inward toward the central axis of the base, thereby constituting a portion of the proximal end surface of the base which abuts the bulkhead of the sleeve. FIG. 4, 6, 7, 16 show Type I shrouds.

Figure 8:
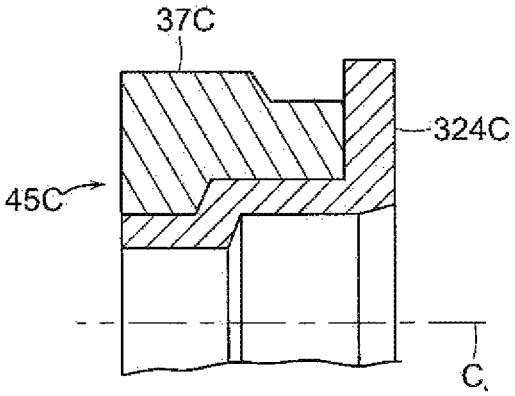

A Type II shroud has a first portion which is ring-like (sleeve-like), like that which comprise a Type I shroud; and in addition a second flange portion, which extends inwardly toward the center axis, thereby constituting a portion of the proximal end surface of the base which abuts the bulkhead of the sleeve. The flange defines a central hole at least large enough to accommodate the nipple of the sleeve. FIG. 5, FIG. 9, FIG. 10, FIG. 11, FIG. 12, and FIG. 13 show Type II shrouds. The shroud of FIG. 8 is somewhat indefinite as to classification but can best be characterized as Type II. The following are examples of shrouds.

A shroud of the present invention is distinguished from a ferrule or sleeve which is of the nature of a coupling which joins part A to part B; or which provides strength to the joint between the casing bulkhead and the base. A shroud of the present invention does not extend lengthwise to overlap a portion of the external surface of the sleeve. A shroud of the present invention has sufficient structure to hold its shape when freestanding and, when loaded axially while freestanding on a workbench, the ability to bear a load of at least about 0.5 pounds (227 g), more likely, a load of 1 pound (454 g) up to 20 pounds (4.4 kg)—depending on the material and diameter of size of shroud/casing. Thus a shroud of the invention is distinct from such as a plastic or paper band that is wrapped around a casing, such as for identification. A shroud of the present invention has a radial direction thickness (that is, a thickness transverse to the lengthwise axis) of at least 0.010 inch (0.0254 mm), more preferably at least 0.15 inch (0.038 mm). A Type I steel shroud might be 0.10 inch (0.0254 mm) thick. The ring-like portion of a shroud may have a thickness of up to 0.1 inch (0.254 mm) in small caliber casings. A preferred shroud radial thickness will be at least 3 to 5 percent the diameter of the base of which the shroud is a part, and may range between 3 and 90 percent.

Type I Shrouds

A Type I shroud is generally a hollow cylinder that runs lengthwise from the proximal end of the base. Type I shrouds may be characterized as being ring-like or as being collars. When a Type I shroud is mounted on a constant diameter exterior surface of a base substrate, it is possible there could be unwanted axial displacement toward the distal end of the casing during handling or use. When a Type I shroud resists force transmitted from a propellant-deflected bulkhead, the shroud's load bearing support can be dependent on the integrity of engagement between the shroud and the exterior of the base substrate. Type I shrouds may be held in place longitudinally on base substrate by such as friction (e.g. (press fit or shrink fit), adhesive or weld, according to the materials involved. Alternately, Type I shrouds may be mechanically constrained, as by being in contact with a shoulder on the base substrate exterior.

Figure 16:
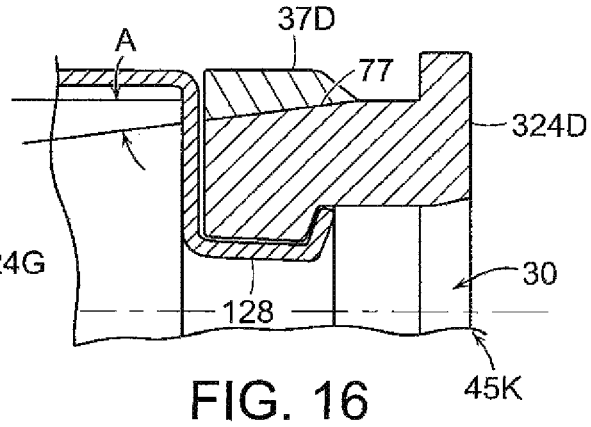
FIG. 16 is a partial lengthwise cross section view of a base assembly of a casing where the shroud bore and the base substrate have mating frusto-conical tapers.

Another way of avoiding such possible shroud-movement problem is, instead of or in addition to any adhesive or friction fit, etc. is to provide a taper fit, as shown for base 45K in FIG. 16. The shroud is received on an exterior surface portion 77 of the base substrate 324D that is frusto-conical in shape, and the shroud 37D has a mating bore. The taper, or angle A measured from the lengthwise axis, of a side of the frusto-conical section of the base substrate can range from 1 to 5 degrees in exemplary embodiments.

Figure 6:
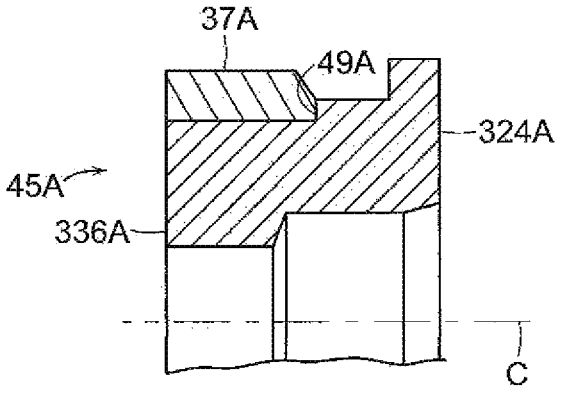
FIG. 6 is a partial lengthwise cross section of the base assembly of a casing showing a base with a cylindrical shape shroud at one end, the shroud bearing against a shoulder that is spaced apart from the breech-block-grip-flange at the end of the base.

In FIG. 6, base 45A comprises shroud 37A which abuts shoulder 49A on the exterior surface of the base substrate 324A. The shoulder prevents the shroud from sliding toward the distal end of the base. The surface 336A of the proximal end of the base, which faces the bulkhead in a casing assembly, is formed by proximal end portions of the base substrate and the shroud.

Figure 7:
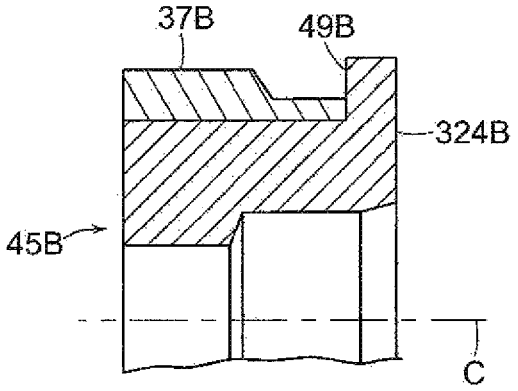
FIG. 7 and FIG. 8 each are partial lengthwise cross section views of the base assembly of a casing, showing a shroud that bears against a shoulder which comprises the breech-block-grip-flange.

In FIG. 7, base 45B comprises shroud 37B on base substrate 324B. The shroud covers all the diametrical exterior surface the base substrate but for distal end flange 49B of the base substrate 324B, with which the shroud is in contact.

In FIG. 8, base 45C comprises shroud 37C and base substrate 324C. The configuration has likenesses to that of FIG. 7. The shroud is thicker and the base substrate has a shoulder.

Type II Shrouds

Figure 9:
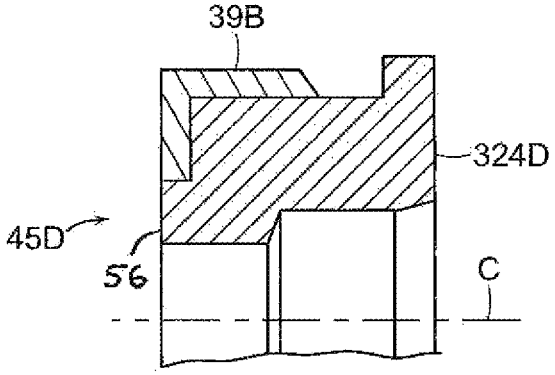
FIG. 9 and FIG. 10 each are partial lengthwise cross section views of the base assembly of a casing, showing a shroud which has a ring-like portion and an inwardly extending flange portion.

With reference to the example of FIG. 5, when a Type II shroud 39 is put on the proximal end of a base substrate 424 to create a base 45J, there is an inwardly running portion, flange 49 of the shroud. FIG. 9 shows base embodiment 45D, where the flange portion of shroud 39B extends inwardly to a boss 56 on the proximal surface of base substrate 324D.

FIG. 10 shows base embodiment 45E, where the flange portion of the shroud extends inwardly to a boss as in base 45D. And the ring like portion of the shroud contacts a shoulder machined in the exterior surface of the base substrate 324E.

Figure 11:
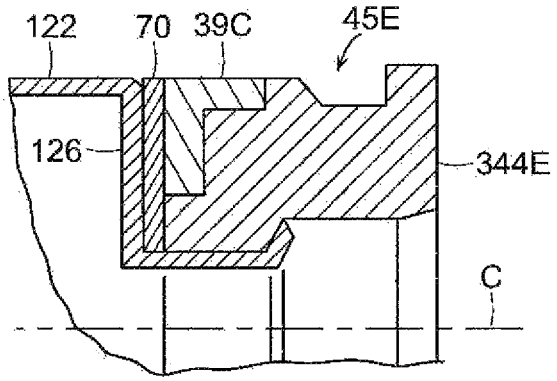
FIG. 11 is a partial lengthwise cross section view of a base assembly like that shown in FIG. 10, also showing a portion of the bottom of a sleeve and a washer captured between the bulkhead of the sleeve and the proximal surface of the base.
Figure 12:
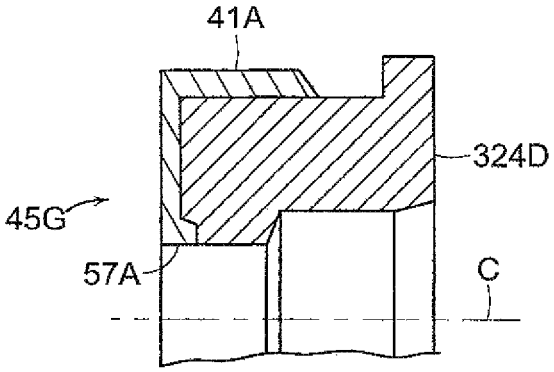
FIG. 12 is a partial lengthwise cross section view of a base assembly of a casing, showing a shroud having a portion that extends partially down the passageway of the base.

FIG. 11 shows base embodiment 45E of FIG. 10 in combination with washer 70 positioned between the bulkhead 126 of the sleeve 122 and the proximal end surface of the base 45E, which surface is provided by portions of base 344E and shroud 39C. The washer may have different properties than the shroud. For example, a washer having higher rigidity (elastic modulus) may be used to distribute bulkhead load onto the base surface which comprises portions of base substrate and shroud. A washer may be used with any of the other embodiments which are described herein.

Mostly, Type II shrouds will be captured in place because they are trapped by a bulkhead. The flange prevents movement of the shroud toward the either end. As desired, Type II shrouds may be additionally held in place on the base substrate by means mentioned above for Type I shrouds. As an artisan will appreciate from his knowledge and from the discussion here, different Types of shrouds, and different embodiments of shroud within any Type, may offer different advantages and disadvantages in functionality, durability and cost. For example, when the shroud provides a portion of the exterior of the base which defines the extraction or gripper groove of the casing base that might be an advantage in machining of the base substrate.

The next part of this description is about features of shrouds which enable identification of a cartridge having a casing comprised of a sleeve and a base comprising a shroud.

In one embodiment of the invention, the shroud whole or surface portion thereof is comprised of pigmented or dyed material which has a color that is different from the color of the base. Examples of this are a colored plastic shroud, and an aluminum shroud which is anodized and dyed. In another embodiment, at least the exterior cylindrical surface of a shroud has a distinct finish, different from that of the base or sleeve. Examples of this are a shroud that has a knurled, serrated, or otherwise textured surface. In another embodiment, a shroud has on its exterior surface words or other decoration which may be imprinted on the shroud surface. Combinations of finish, color, and decoration may be employed on a shroud.

RFID tags are small circuits, frequently powered by magnetic induction or radio waves sent by a transmitter, which circuits send self-identification information when interrogated. Thus a RFID tag can identify a cartridge if affixed to it. Each tag can have a unique identifier. Thus at the time of manufacture an electronic reader can determine and store information showing which cartridges have been put in which box of cartridges; and the box can be given its own identifier in the form of a RFID tag or otherwise. Thus, if a cartridge or casing is recovered in the future, there is a history that may enable tracing of the manufacture and movement to sale of the cartridge to an end user. If exposed on the surface of a casing a RFID tag may be subject to damage during handling or use of a cartridge.

Figure 13:
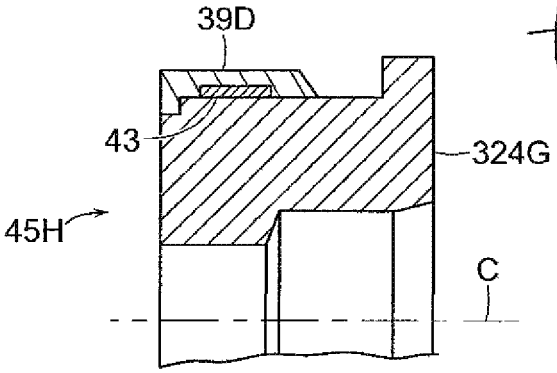
FIG. 13 is a partial lengthwise cross section of the base assembly of a casing, showing a shroud which has captured beneath it a RFID tag.
Figure 14:
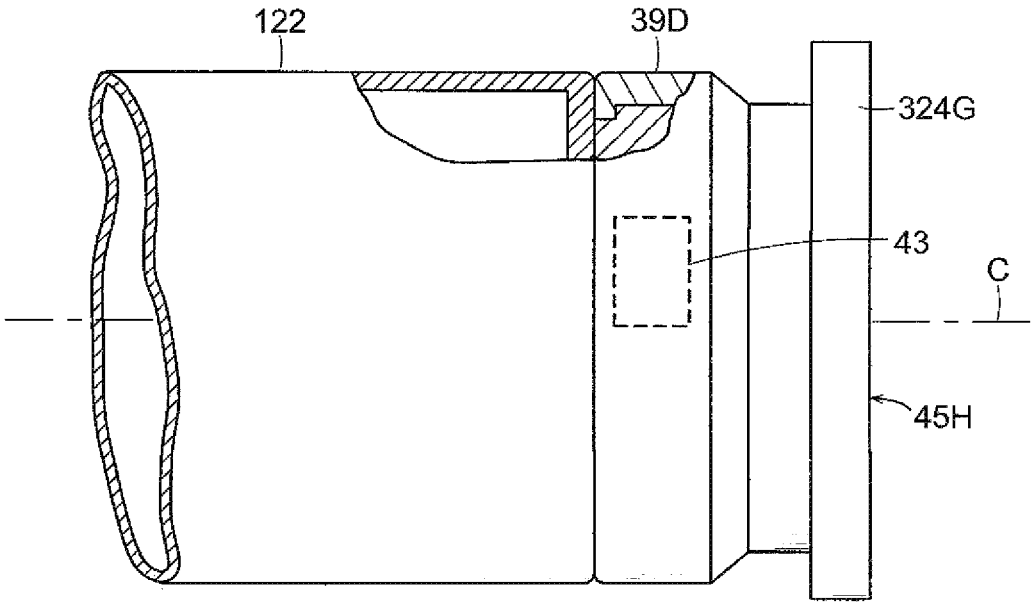
FIG. 14 is a partial-section a portion of the casing shown in FIG. 13, where the casing has been rotated 90 degrees to show the location of the RFID tag.

In the present invention, the tag is set into, embedded within or captured underneath a shroud, alternately within the base. FIG. 13 shows tag 43 that is contained within a recess underneath the shroud 39D that is on the end of base substrate 324G of base 45H. The shroud is made of a material which is transmittive of electromagnetic energy to or from the tag. For example, the shroud is made of a polymer. FIG. 14 is a side view of a casing comprising the base 45H, rotated 90 degrees from the view of FIG. 13. The tag can send and receive radio signals through the plastic of the shroud. In an alternative embodiment, the shroud is made of a ceramic or glass material, which material may provide structural support to the base, better than a common polymer.

Figure 15:
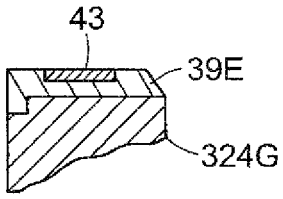
FIG. 15 is a fragmentary lengthwise cross section of a base, showing an alternative shroud which can be used with the base shown in FIG. 13, where the RFID tag is on the surface of the shroud.

FIG. 15 shows an alternate embodiment, shroud 39E, which is also suited for use on the base substrate 324G. The shroud 39E has tag 43 embedded in a cavity on the surface of the shroud. Not shown, the tag may be protectively covered with a thin layer of plastic or other material; and alternatively, the tag may be embedded deeper within the shroud than shown.

The next part of this description relates to the structural features and material properties of shrouds and other parts of a casing. Table 1 presents properties of capacities of some materials which can be considered for shrouds, base substrates, and sleeves, along with some reference materials. Some data are approximate or estimated.

TABLE 1

Properties of some materials that are considered for use in casings.

| Material | Yield Strength (Flexural for ceramic; transverse rupture for ceramic) MPa | ksi | Elastic Modulus, E GPa | $10^6$ psi | Hardness |
|---|---|---|---|---|---|
| Shroud | | | | | |
| ABS | 72 | 10.5 | 2.3 | 0.33 | R103 |
| Nylon 6/6 | 110 | 16 | 2.8 | 0.41 | R121 |
| Alumina | 275-1034 | 40-150 | 380 | 55 | 18-23 HK or HV |
| 6061 T6 aluminum | 275 | 30 | 69 | 10 | 30 HB |
| Base | | | | | |
| 7075 T6 aluminum | 505 | 73 | 72 | 10.4 | 150 HB |
| cartridge brass | 434 | 63 | | | |
| EZAC zinc base | 448 | 65 | 83 | 12 | |
| Sleeve | | | | | |
| AISI 304 stainless* | 193 | 28 | 193 | 28 | |
| AI5I 304 stainless work hardened | 861 | 75-125 | 193 | 28 | RC31 |
| AISI 410 stainless* | 200 | 29 | 200 | 29 | |

* = annealed

In embodiments of the invention, a base substrate first has to have a property set sufficient for handling the forces associated with deforming of the nipple within the passageway, and sufficient for achieving a seal with nipple lip. The base substrate, and the base as a whole, has to handle the forces imposed by the breech block during firing of a bullet, along with the forces imposed by grips of the firearm during removal of the casing from the breech after firing. Another criterion is the fabricability of the material, with machining from bar stock preferred.

In embodiments of the invention a sleeve preferably formed of austenitic stainless steel, more particularly AISI 304 wrought stainless steel which is made magnetic by cold working. A preferred steel for a sleeve will have a substantially higher property set than characterizes cartridge brass and the like, thus enabling thinner cylindrical casing walls than are achievable with brass in prior art cartridges. Alternative sleeve materials may include certain other 300 series stainless steels, a 400 series stainless steel, or a plated carbon steel or high strength low alloy steel.

In some embodiments of the present invention, the sleeve has high strength and hardness, while the base has lower strength and hardness. This is advantageous not only for weight, but in that if the base were made of material which had the same strength and hardness as a stainless steel sleeve, then that can cause excessive wear or decreased life of the griping and ejecting parts of the breech block.

Materials used for the base substrate of a casing having a shroud may be like those used for bases when there is no shroud. A preferred base substrate is a 7000 series aluminum alloy having a Rockwell B hardness in the range of 70 to 98. Aluminum alloy 7075 in T6 heat treatment condition is preferred. When aluminum, the base substrate may be anodized and dyed for color coding, to demark different types of cartridges. Alternatively, the base substrate may be plated with electroless nickel phosphorous metal.

Alternative materials for the base substrate may include other aluminum alloys, 304 stainless steel, copper alloys (e.g. cartridge brass), and zinc base die-casting alloy, e.g. Eastern Alloy or equivalent (EZAC, ZA 27, Zamak 7, Zamak5, Zamak 2, ACuZinc5). A base substrate may be formed by stamping, pressing, casting or machining, as applies to the particular material.

Desirably, the bulkhead of a sleeve abuts the proximal surface of the base and desirably receives structural support from the base, to help the sleeve resist the forces imposed by the pressure of deflagrating propellant within the sleeve during firing of a bullet. If a casing is repetitively re-used fatigue failure ought to be avoided. How much support the base, and in particular a shroud, can needs to provide depends on the configuration and material of the sleeve, and on the pressures which the sleeve must endure. So, it can be appreciated that in some instances, good support from the shroud is needed, but in other instances no support from the shroud is needed beyond what the base substrate provides.

With reference to the casing of FIG. 4 (and analogously the casing of FIG. 5), the surface 336 of base 45 can provide structural support to the outer edge 140 region of bulkhead 126 of sleeve 122, when it is pressurized by firing. Failure at near edge 140 can occur due to one-time or repetitive pressures; and, supporting the bulkhead outer edge, to lessen distal direction deflection is believed to reduce any propensity for failure near edge 140. To provide such longitudinal direction support, a shroud is made of a material with good load resisting property, and such a shroud is capable of transferring the load to base substrate mechanically, as by being attached in ways described.

A load bearing shroud will preferably have a yield strength greater than 45,000 psi, more preferably greater than 60,000 psi (60 ksi). A shroud may be made of a high tensile strength steel, or of a high elastic modulus material (for instance, Molybdenum 362 or TZM) to provide strength to a base comprised of a substrate made of such as aluminum alloy or ceramic.

Alternatively a shroud may less capable material, including such non-metal materials as a plastic thermoset plastic such as an epoxy resin or polyester resin, a thermoplastic such as polyethylene, polypropylene, nylon, all preferably with fiber filler and other filler an engineered plastic or composite material, or some hot pressed ceramic, and others.

If a shroud is made of a low elastic modulus or low structural strength material, such as a common polyolefin plastic, it does not much provide a desired structural support. As described in connection with FIG. 11, a washer having good strength and higher modulus than the material of the shroud may help. If a shroud is made of a material which has equal or greater property set, compared to the property set of a one piece base made of the same material as the base substrate, that may enhance the structural support, provided the shroud is able to transfer load to the distal end of the base substrate and thus to the breech block of the firearm.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A casing, for use as part of a cartridge for a firearm, comprising a sleeve and a base connected to each other, the base comprised of a base substrate and a shroud; each of the sleeve, base, base substrate, and shroud having a length, a lengthwise axis, a distal end, a proximal end, and an exterior surface; the base and the sleeve having abutting exterior surfaces that comprise a casing exterior surface;

the base substrate having a lengthwise passageway, wherein a portion of the passageway is a recess at the distal end of the base substrate shaped for receiving a primer, the recess defining a shoulder within the passageway;

the sleeve having a length, a proximal end comprising a mouth opening shaped for receiving a bullet, a circular wall portion running in the direction of the sleeve distal end, a bulkhead integrally connected to said wall portion at a bulkhead circular outer edge and running substantially transverse to the sleeve length, and a nipple extending lengthwise from the bulkhead in the direction of the base distal end;

wherein the nipple is positioned within said passageway of the base substrate and secured therein by an outwardly flaring lip of the nipple which is in contact with the shoulder of the base substrate; and, wherein the shroud is mounted on a portion of the exterior surface of the base substrate and comprises a substantially cylindrical ring portion;

wherein a portion of the base substrate exterior surface and a portion of the shroud exterior surface in combination form the exterior surface of the base;

wherein the proximal ends of both the shroud and the base substrate form a base proximal end surface which is in contact with or in close proximity to said sleeve bulkhead; and, wherein the shroud proximal end has an exterior diameter matching the diameter of the circular outer edge of the sleeve bulkhead.

2. The casing of claim 1 wherein the shroud cylindrical ring portion has, in the direction transverse to the lengthwise axis of the base substrate, a wall thickness of 0.010 inch or more, and wherein said thickness is more than five percent of the diameter of the base at the proximal end thereof.

3. The casing of claim 1 wherein the base substrate has a tapered exterior surface and the shroud has, in contact with said tapered exterior surface, a bore with a taper.

4. The casing of claim 1 wherein the base substrate exterior surface comprises a shoulder spaced apart from the distal end of the base substrate; and, wherein the distal end of the shroud abuts said shoulder.

5. The casing of claim 1 wherein the distal end of the base substrate comprises an outwardly running flange; wherein the shroud runs lengthwise to said flange; and, wherein the shroud has a reduced diameter portion in proximity to said flange.

6. The casing of claim 1 wherein the shroud has a first portion which is a substantially cylindrical ring and a second portion at the proximal end comprising a flange running radially inwardly toward the passageway of the base.

7. The casing of claim 6 wherein the shroud of claim 6 has, in a direction transverse to the lengthwise axis of the base, a wall thickness of 0.010 inch or more; and, wherein said thickness is more than five percent of the diameter of the base at the proximal end thereof.

8. The casing of claim 6 wherein the base substrate exterior surface comprises a shoulder spaced apart from the distal end of the base substrate; and, wherein the distal end of the shroud abuts said shoulder.

9. A cartridge comprising a casing of claim 6 in combination with a bullet captured within the mouth of the proximal end of the sleeve, a quantity of propellant contained within the wall portion of the sleeve, and a primer set within the recess of the base substrate.

10. The casing of claim 6 wherein the base substrate has a first property set comprising yield strength, elastic modulus and hardness, and the shroud has a corresponding second property set, wherein the value of each property of the second property set is substantially greater than the corresponding value of each property of the first property set.

11. The casing of claim 1 wherein the base substrate has a first property set comprising yield strength, elastic modulus and hardness, and the shroud has a corresponding second property set, wherein the value of each property of the second property set is substantially greater than the corresponding value of each property of the first property set.

12. The casing of claim 1 wherein the base substrate is made of a first metal alloy comprising a base metal and the shroud is made of a metal alloy comprising the same base metal.

13. The casing of claim 1 wherein the shroud has an exterior surface which is visually different in color or texture from the exterior surface of the base substrate.

14. A cartridge comprising a casing of claim 1 in combination with a bullet captured within the mouth of the proximal end of the sleeve, a quantity of propellant contained within the wall portion of the sleeve, and a primer set within the recess of the base substrate.

* * * * *